United States Patent [19]

Brede et al.

[11] Patent Number: 4,850,274

[45] Date of Patent: Jul. 25, 1989

[54] MULTIPLE-CHAMBER PROPELLANT CHARGE IGNITER

[75] Inventors: Uwe Brede; Erich Zeiher, both of Fürth, Fed. Rep. of Germany

[73] Assignee: Dynamit Nobel Aktiengesellschaft, Troisdorf, Fed. Rep. of Germany

[21] Appl. No.: 129,771

[22] Filed: Dec. 7, 1987

[30] Foreign Application Priority Data

Dec. 16, 1986 [DE] Fed. Rep. of Germany ..... 3642942

[51] Int. Cl.[4] ..... F42C 19/08

[52] U.S. Cl. ..... 102/202; 102/380; 102/289

[58] Field of Search ..... 102/202, 204, 289, 380; 60/256, 39.823

[56] References Cited

U.S. PATENT DOCUMENTS

| | | | |
|---|---|---|---|
| 2,948,219 | 8/1960 | Sapp | 102/204 |
| 2,990,684 | 7/1961 | Cohen | 60/256 |
| 3,162,127 | 12/1964 | Breslow et al. | 102/204 |
| 3,286,472 | 11/1966 | Thurston | 60/250 |
| 3,423,943 | 1/1969 | Stark | 102/289 |
| 4,047,483 | 9/1977 | Williams | 102/380 |

FOREIGN PATENT DOCUMENTS

| | | | |
|---|---|---|---|
| 1154978 | 9/1963 | Fed. Rep. of Germany | 102/380 |
| 2509058 | 9/1976 | Fed. Rep. of Germany . | |
| 3113406 | 12/1982 | Fed. Rep. of Germany . | |
| 2357861 | 7/1977 | France . | |

*Primary Examiner*—Deborah L. Kyle
*Assistant Examiner*—Michael J. Carone
*Attorney, Agent, or Firm*—Antonelli, Terry & Wands

[57] ABSTRACT

The invention relates to a propellant charge igniter comprising at least two series-connected combustion chambers separated from one another by choke disks, respectively one igniter mixture being housed in these chambers, these igniter mixtures differing from one another with respect to their combustion characteristics and thus exhibiting differing combustion behavior. The combustion chamber volumes are adapted to these igniter mixtures so that the mixture can burn up at the pressure level that is an optimum for the mixtures in each case.

18 Claims, 2 Drawing Sheets

MULTIPLE-CHAMBER PROPELLANT CHARGE IGNITER

This invention relates to propellant charge igniters with a primary igniter element and with an igniter mixture arranged in a combustion chamber and having the form of a molded member.

Propellant charge igniters serve for the ignition of propellant charges, especially propellant charge powder beds. These propellant charge igniters are utilized, for example, in rockets, propellant charge cartridges, or launching charges, or for pyrotechnical items However, they are used in particular for igniting the propellant charge of ammunition for barrel weapons and thus are called propellant charge igniters.

In such propellant charge igniters, the igniter element, which can be triggered mechanically or electrically, is separated spatially from a booster charge, the latter effecting, as a second mixture of materials, the actual igniting process, i.e. ignition of the propellant charge powder.

Suitable booster charges are igniter mixtures of various shapes and compositions. These igniter mixtures can also be in the form of molded components (ring tablets, disks, cylinders, etc.).

A propellant charge igniter is to ignite, with a minimum of mechanical stress, a propellant charge powder bed in the entire usage temperature spectrum with maximum speed and uniformity.

The disadvantages of the conventional propellant charge igniters reside in nonuniformities of the flow rate of the exhausted ignition gases and in the varying duration of exhaustion of the ignition gases.

Thus, it is known that in case of influx velocities of the ignition gases that are too high when entering a propellant charge powder bed, extinction processes can occur on the surface of the propellant charge powder. This leads to a more or less extensive scattering in the ignition of the propellant charge powder bed.

It is an object of the present invention to provide a propellant charge igniter ensuring improved ignition of the propellant charge powder bed.

This object has been attained by means of a propellant charge igniter having a primary igniter element and an ignition mixture arranged in a combustion chamber and having the shape of a molded member, characterized in that at least two combustion chambers are included which are connected in series and are separated from each other respectively by a choke disk and are in direct operative connection via this choke disk; and that an igniter mixture is present in each combustion chamber different from the other igniter mixture(s) with respect to its combustion properties.

The propellant charge igniter of this invention suitably comprises a cylindrical housing, one end of which is sealed by a bottom piece wherein the primary igniter element is accommodated.

A first combustion chamber housing on igniter mixture is disposed ad]adjacent to the bottom piece. This first combustion chamber is in communication, via a choke disk, with an adjacently located, second combustion chamber which latter likewise contains another igniter mixture.

The igniter mixtures are advantageous arranged in the central zone of the combustion chambers The shape and composition of the igniter mixtures are suitably chosen so that their combustion properties differ greatly from one another. The combustion chambers are suitably designed so that they are adapted optimally to the igniter mixtures housed therein is far as possible.

This multiple-chamber system ensures that the different igniter mixtures which, as is known, require differing combustion pressure levels, can deflagrate at the pressure level that is respectively at an optimum for each.

On account of the presence of at least two combustion chambers and differing igniter mixtures provided therein, it is possible to create ignition conditions that are at an optimum for a given propellant charge powder bed. Thus, it is possible to bring about optimum intermixing of the ignition gases, consisting of gas, condensates, and hot particles. Additionally, the flow rate of the ignition gases as well as the exhaust period can be adjusted.

In order to attain this objective, the choke disk is equipped with a plurality of exhaust bores in a preferred embodiment of this invention. These exhaust bores preferably exhibit varying diameters. Due to this fact, and due to the arrangement of these exhaust bores, the exhaust flow rate of the ignition vapors can be controlled with respect to time.

In accordance with another preferred embodiment, the igniter mixtures are present as press-molded members. It is thereby possible to impart a specific shape to the igniter mixtures, likewise permitting a timed control of the exhaust flow velocities of the ignition vapors.

The respective combustion chamber volume is preferably attuned to the combustion properties of the igniter mixtures. This adaptation is preferably arranged in the combustion chamber. These are inert inserts for the combustion chambers making it possible to vary the spacing of the igniter mixtures from choke disk(s) and/or bottom or end member, as well as the combustion chamber volume.

The adapter members are preferably annular spacers (distance-maintaining elements). The outer diameter of these spacers is preferably of such a dimension that the spacers are in contact with the inner wall of the housing.

In a preferred embodiment, the igniter mixtures, present as press-molded articles, are retained in the central region of the combustion chamber by respectively one spacer (distance-maintaining element) located above and below these igniter mixtures The last combustion chamber, i.e. The combustion chamber facing away from the igniter element, is preferably equipped with an end member provided with at least one exhaust bore. The shape and/or diameter of this exhaust bore or, respectively, of the main exhaust nozzle, are selected likewise in such a way that the ignition gases exit in the desired manner.

In the manufacture of the propellant charge igniter according to this invention, the bottom piece, the adapter members, the choke disk, and the end member are suitably produced in one piece by the cold extrusion technique. This holds true especially for mass production.

The invention will be described in greater detail with reference to the accompanying drawings preferred embodiments wherein.

Figure 1:
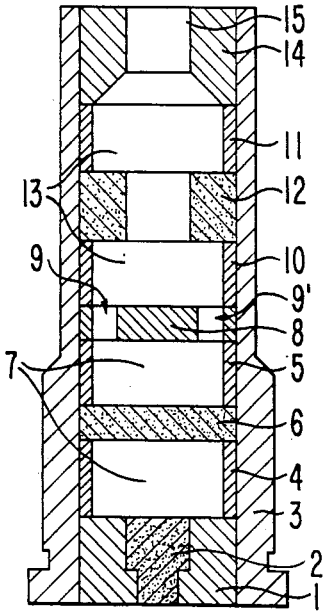
FIG. 1 shows a longitudinal section through a propellant charge igniter according to this invention with two combustion chambers.

The propellant charge igniter illustrated in FIG. 1 with two combustion chambers comprises a cylindrical housing 3 sealed at the bottom end by a disk-shaped bottom piece 1. A primary igniter element 2 is housed in this bottom piece 1; this igniter element can be triggered either electrically or mechanically.

The first combustion chamber 7 is formed by the cylindrical housing 3, the bottom piece 1, and the choke disk 8. The choke disk 8 (see FIG. 4) has exhaust bores or ports 9',9. The size of the combustion chamber 5 is adjusted by the length and the volume of the adapter members 4, and by the thickness of the igniter mixture 6 which latter is in the form of a press-molded component or element.

The adjoining second combustion chamber 13 is defined by the cylindrical housing 3, the choke disk 8, and the end member 14 which has an exhaust bore 15. The size of the second combustion chamber 13 is determined by the length and the volume of the adapter members 10, 11 and by the thickness of the igniter mixture 12, present in the form of a press-molded component or element.

The adapter members 4, 5, 10 and 11 are, in the embodiment shown in FIG. 1, annular spacers (distancemaintaining elements) in contact with their outer walls with the inner wall of the housing 3. The igniter mixtures 6, 12, in the form of press-molded articles, are suitably of a disk shape and, with their outer diameters, are likewise in contact with the inner wall of the housing 3. These press-molded components thus rest on the spacers and are held by the spacers in the central zone of the combustion chambers 7, 13.

The mode of operation of this propellant charge igniter illustrated in FIG. 1 is as follows:

After an either mechanical or electrical initiation of the primary igniter element 2, the thus-formed reaction products are blown into the combustion chamber 7 and ignite the igniter mixture 6 present as a press-molded component.

When this igniter mixture consists of a nitrocellulose powder, hot gases are predominantly formed. The thus-arising gas pressure in the combustion chamber 7 is regulated by the size of the combustion chamber 7 and by the choice of the exhaust bores 9, 9' of the choke disk 8. In this process, the choke disk 8 shown in FIG. 4 acts, due to differently sized exhaust bores 9, 9', as a pressure-responsive valve. The large exhaust bores 9 exert a small throttling effect on the combustion products of the igniter mixture 6; whereas the small exhaust bores 9' exert a blocking action that becomes the more effective, the higher the pressure rises in the combustion chamber 7. By optimizing the diameters of the exhaust bores 9, 9' (for example, several different bore diameters), it is thus possible to attain a combustion pressure in the combustion chamber 7 that can be varied within wide limits, as well as a controlled mass throughput of the gases through the choke disk.

Figure 4:
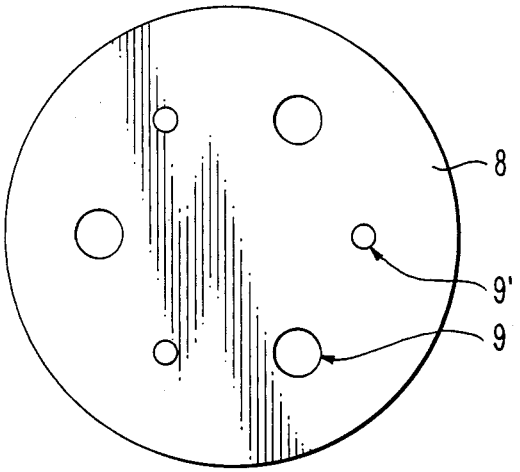
FIG. 4 shows an end view of the choke disk 8 illustrated in FIG. 1.

The combustion products of the ignited mixture 6 are conducted into the second combustion chamber 13 by way of the exhaust bores 9, 9' of the choke disks shown in FIG. 4. These combustion products ignite the igniter mixture 12 disposed therein as a press-molded element. This press-molded element can be, for example, an annular tablet of boron potassium nitrate. In this case, the combustion products of the igniter mixture consist primarily of hot particles and condensates.

Figure 3:
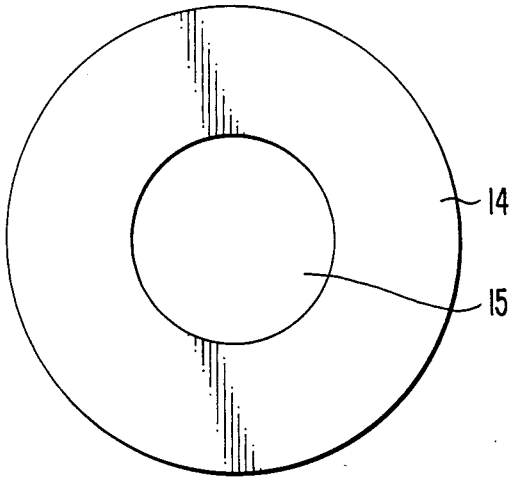
FIG. 3 shows an end view of the end member 14 illustrated in FIG. 1.

The optimum pressure level is adjusted by the length of the adapter members 10, 11 and the thickness of the press-molded igniter mixture 12. The hot gaseous products of the igniter mixture 6, mixed in the second combustion chamber 13, exit together with the hot particle-condensate gas mixture of the second igniter mixture 12 as a combined ignition vapor through exhaust bore 15 of the end member 14 shown in FIG. 3 and bring about ignition of a subsequently located propellant charge powder bed housed, for example, in a cartridge.

Figure 2:
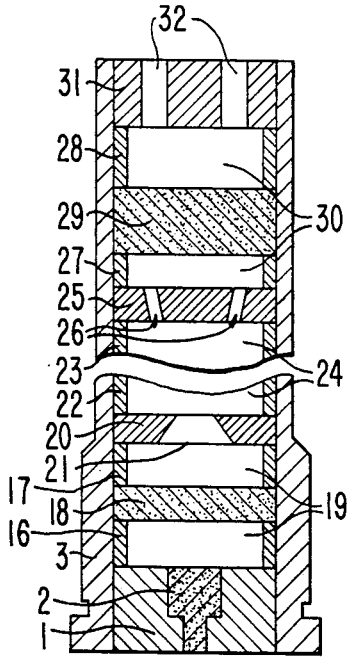
FIG. 2 shows a longitudinal section through a propellant charge igniter according to this invention with more than two combustion chambers.

The propellant charge igniter of this invention with several combustion chambers, shown in FIG. 2, also comprises a cylindrical housing 3 with a bottom piece 1 accommodating the primary ignition element 2 which can be triggered electrically or mechanically. The first combustion chamber 19 is constituted by the housing 3, the bottom piece 1, and the choke disk 20 provided with an exhaust bore 21. The size of the combustion chamber it determined by the length and the volume of the adapter members 16, 17 and the thickness of the press-press-molded igniter mixture member 18.

The additional combustion chamber(s) 24 is (are) illustrated in FIG. 2 in a simplified view and exhibit(s) adapter members 22, 23 and a choke disk 25 with obliquely arranged exhaust bores 26, 26', which can be of different sizes as the bores 9, 9' shown in FIG. 1, i.e., a number are large and a number are small.

The final combustion chamber 30 of the multiple-chamber system is formed by the choke disk 25, the housing 3, and the end member 31 with the exhaust bores 32. The size of this combustion chamber 30 is determined by the adapter members 27, 28 and the press-molded igniter mixture member 29.

The adapter members 16, 17, 22, 23, 27, 28, and the igniter mixtures 18, 29, present as press-molded parts, of the embodiment of the propellant charge igniter of this invention shown in FIG. 2 are of the same structure as the corresponding parts of the embodiment illustrated in FIG. 1, i.e. these are annular spacers and, respectively, press-molded disks. The diameter of the choke disks 20, 25 is dimensioned, just as in the embodiment shown in FIG. 1, so that they are in contact, with their radial lateral surfaces, with the inner wall of the cylindrical housing 3.

The propellant charge igniter shown in FIG. 2 differs from that of FIG. 1 in that there is or are interposed one (or several) additional combustion chamber(s) between the combustion chamber 19 adjacent to the igniter element 2, and the final combustion chamber 30 sealed by the end member 31 It is thereby possible to the use of differently shaped and composed igniter mixtures and/or press-molded igniter mixture components so that the exiting ignition gases exhibit a temperature, velocity, and so forth at an optimum for ignition of the propellant charge powder bed.

What is claimed is:

1. A propellant charge igniter comprising a cylindrical housing containing a primary igniter element at one end, at least two combustion chambers and an igniter mixture arranged in each of the combustion chambers and formed as a press-molded article, said at least two combustion chambers being connected in series and being separated from each other, respectively, by a choke disk and being in direct operative connection via said choke disk; and the igniter mixture located in one of the combustion chambers being different from the igniter mixture located another combustion chamber with respect to its combustion properties.

2. A propellant charge igniter according to claim 1, characterized in that the choke disk has at least one exhaust bore.

3. A propellant charge igniter according to claim 2, characterized in that the choke disk has several exhaust bores of differing diameters.

4. A propellant charge igniter according to claim 1, characterized in that the respective volume of the combustion chambers is adapted to the combustion properties of the igniter mixtures housed therein.

5. A propellant charge igniter according to claim 4, characterized in that, for adaptation of the volumes of the combustion chambers adapter members are arranged in the combustion chambers.

6. A propellant charge igniter according to claim 5, characterized in that the adapter members comprise annular spacers arranged with the cylindrical housing.

7. A propellant charge igniter according to claim 1, characterized in that the final combustion chamber of said series exhibits an end member with at least one exhaust bore.

8. A propellant charge igniter according to claim 1, characterized in that one or several, of the igniter mixtures contain finely ground, inert material including particles of carbon or metal.

9. A propellant charge igniter according to claim 1, characterized in that said primary igniter element is located in a bottom piece sealing the one end of the cylindrical housing; said bottom piece and said primary igniter element defining an end portion of a first combustion chamber of said at least two combustion chambers and said primary igniter element, upon ignition, blowing reaction products directly into said first combustion chamber to ignite the igniter mixture present as a press-molded component in said first combustion chamber.

10. A propellant charge igniter according to claim 9, characterized in that said first combustion chamber contains an igniter mixture comprising a gas-rich generating charge which builds up pressure rapidly and a next successive combustion chamber contains an igniter mixture comprising a charge which generates hot particles whereby a mixture of gases and hot particles are discharged from the other end of said cylindrical housing to effect ignition of a propellant charge powder bed.

11. A propellant charge igniter comprising a cylindrical housing, a bottom piece, at least two combustion chambers arranged in series, and an end member; said housing being sealed at one end by the bottom piece, a primary igniter element housed within said bottom piece and the end member being located at the other end of said housing, said end member having an exhaust port for allowing discharge of reaction products from the at least two combustion chambers within said housing; said at least two combustion chambers being positioned with said housing between the bottom piece and the end member, the reaction products from a first combustion chamber discharging into a next successive combustion chamber; said at least two combustion chambers being separated from each other by choke means for regulating the pressure within a combustion chamber arranged upstream of said choke means and providing direct operative communication between successive combustion chambers; an igniter mixture, formed as a press-molded component, arranged in each of said at least two combustion chambers so as to be spaced from a choke means; the igniter mixture located in the first combustion chamber being different from the igniter mixture located in another of said at least two combustion chambers with respect to the combustion properties of each, and said first combustion chamber being defined by said bottom piece, an annular spacer member having an outer wall contacting an inner wall of the cylindrical housing and a choke means and a final combustion chamber of the at least two combustion chambers being defined by the end member, an annular spacer member having an outer wall contacting an inner wall of the cylindrical housing and a choke means.

12. A propellant charge igniter according to claim 11, wherein the first combustion chamber contains an igniter mixture comprising a gas-rich generating charge which builds up pressure rapidly and a next successive combustion chamber contains an ignition mixture which generates hot particles whereby a mixture of gas and hot particles is discharged from the exhaust port of said end member.

13. A propellant charge igniter according to claim 11, wherein the choke means comprises a choke disk having at least one exhaust bore formed therein.

14. A propellant charge igniter according to claim 13, wherein said choke disk has several exhaust bores of different diameters formed therein.

15. A propellant charge igniter according to claim 11, wherein at least two annular spacer members cooperate to define a combustion chamber; said igniter mixture being positioned between said annular spacer members, an outer periphery of the igniter mixture contacting an inner wall of the cylindrical housing.

16. A propellant charge igniter according to claim 11, wherein at least one of the igniter mixtures in one of the next successive combustion chambers contains finely ground inert material including particles of carbon or metal.

17. A propellant charge igniter according to claim 11, wherein the igniter mixture in each of said at least two combustion chambers is arranged in a central zone of a combustion chamber so that a free space is provided above and below the igniter mixture.

18. A propellant charge igniter according to claim 11, wherein two combustion chambers are arranged in the cylindrical housing with choke means comprising a choke disk arranged therebetween, said choke disk being retained by annular spacer members.

* * * * *